US006120575A

United States Patent [19]

Arvidsson et al.

[11] Patent Number: 6,120,575

[45] Date of Patent: Sep. 19, 2000

[54] AGGLOMERATED IRON-BASED POWDERS

[75] Inventors: Johan Arvidsson, Nyhamsläge; Fredrik Emilsson, Ängelholm, both of Sweden

[73] Assignee: Höganäs AB, Höganäs, Sweden

[21] Appl. No.: 09/325,348

[22] Filed: Jun. 4, 1999

Related U.S. Application Data

[63] Continuation of application No. PCT/SE97/02062, Dec. 10, 1997.

[30] Foreign Application Priority Data

Dec. 10, 1996 [SE] Sweden ..... 9604538

[51] Int. Cl.[7] ..... B22F 1/00

[52] U.S. Cl. ..... 75/252

[58] Field of Search ..... 75/231, 239, 246, 75/252; 419/14, 23, 36, 37, 48

[56] References Cited

U.S. PATENT DOCUMENTS

| | | |
|---|---|---|
| 4,946,499 | 8/1990 | Sakuranda et al. . |
| 5,135,566 | 8/1992 | Sakuranda et al. . |
| 5,368,630 | 11/1994 | Luk . |
| 5,429,792 | 7/1995 | Luk . |

FOREIGN PATENT DOCUMENTS

| | | |
|---|---|---|
| 0118716A1 | 9/1984 | European Pat. Off. . |
| 0310115A1 | 4/1987 | European Pat. Off. . |
| 0719608A2 | 7/1996 | European Pat. Off. . |
| WO94/23868 | 10/1994 | WIPO . |

*Primary Examiner*—Ngoclan Mai

*Attorney, Agent, or Firm*—Burns, Doane, Swecker & Mathis, L.L.P.

[57] ABSTRACT

The invention concerns a process for the preparation of a free flowing agglomerated iron-based powder comprising mixing dry ingredients of: a) 63–95% by weight of a fine base powder consisting essentially of iron and having a particle size essentially less than 75 $\mu$m; b) 5–20% by weight of a lubricating phase having a particle size essentially less than 120 $\mu$m, preferably less than 60 $\mu$m; c) 0–15% by weight of a hard phase material having a particle size essentially less than 10 $\mu$m; and d) 0–7% of additives in a mixing chamber; evacuating the mixing chamber; filling the mixing chamber with an insert gas, mixing the ingredients with at most 1% by weight of a binding agent, and adding a solvent and drying the obtained powder.

8 Claims, No Drawings

AGGLOMERATED IRON-BASED POWDERS

This is a continuation of International Application No. PCT/SE97/02062 filed Dec. 10, 1997, that designates the United States of America and which claims priority from Swedish Application No 9604538-0, filed Dec. 10, 1996.

The present invention concerns agglomerated iron-based powders and a method for the preparation thereof. More specifically, the invention concerns agglomerated iron-base powders for the preparation of wear resistant materials, which combine low friction, good wear resistance and self lubricating and which advantageously can be used in e.g. heavy-duty diesel engines. When using the agglomerated powders these materials can be prepared by conventional technique from inexpensively raw materials in existing plants.

From theoretical and practical considerations it has been found that the starting materials for such wear resistant material could be selected from the following materials.

a) 63–95% by weight of a fine base powder consisting essentially of iron and having a particle size essentially less than 75 $\mu$m
b) 5–20% by weight of a lubricating phase having a particle size essentially less than 120 $\mu$m and preferably less than 60 $\mu$m
c) 0–15% by weight of a hard phase material having a particle size essentially less than 10 $\mu$m, and
d) 0–7% of additives including binding agent (s), solvent (s) and optionally lubricant (s)

The base powder could be selected from the group consisting of prealloyed powders, partially prealloyed powders or pure iron powders, Examples of prealloyed powders are e.g. Astaloy Mo and the partially prealloyed powders can be e.g. Distaloy SE and Distaloy AE. Pure iron powders which advantageously could be used are e.g. ASC 100.29, NC 100.24, SC 100.26 and AHC 100.29. All powders are available from Höganäs AB, Sweden.

The lubricating phase according to the invention is present also after the sintering process and is a solid inorganic material. Examples of such materials are metal sulphides, metal chlorides and metal fluorides. A preferred material in MnS. The lubricating phase could also be MnX available form Höganäs AB, Sweden. If more than 20% is added the strength will be adversely affected and if less than 5% is added the friction will be too high. According to a preferred embodiment the amount of the lubricating phase is 5–15% by weight.

The hard phase powder is selected from carbides, such as NbC, TiC, VC, TaC. If the amount of the hard phase power is more than 15% the compressibility will be too low. According to a preferred embodiment the amount of hard phase powder is not more than 10%. In practice the amount of the hard phase powder is chosen in view of the desired wear resistance.

The different additives could be selected from the group consisting of $Fe_3P$, graphite and /or various conventional lubricants, such as waxes, stearates and polymers.

Unexpected problems were encountered when these powder mixtures should be used on an industrial scale, as it turned out that the powders had essentially no flow and good flow is a necessary prerequisite for industrial production. Other disadvantages involved too much segregation and dusting during handling.

According to the invention these problems have been obviated by using a process including the following steps:

1) Mixing the dry ingredients according to points a)–d) above in a mixing chamber.

2) Evacuating the mixing chamber to less than 25, preferably less than 15 mbar.

3) Filling the mixing chamber with an inert gas to slight underpressure to about 950, preferably about 900 mbar.

4) Mixing the ingredients with less than 1% by weight, based on the whole mixture, of a binding agent and adding a solvent.

5) Drying the obtained powder.

An important feature of the granulation process is the low amount of binding agent, which is beneficial to the subsequent sintering process and, consequently, to the final product. The binding agent could be any conventional binding agent used within the P/M field. More specifically, the binding agent could be selected from the group consisting of polyesters and polyalcohols. Cellulose acetate butyrate is a presently preferred binding agent.

The solvent depends on the binding agent and is selected from the group consisting of water, alcohols and ketones. A preferred solvent is acetone.

The agglomerated powder, which has a particle size essentially between about 75 and 150 $\mu$m, can be uniaxially compacted to a green body having a density exceeding 85 and preferably exceeding 90 percent of the theoretical density.

In order to prepare the final wear resistant material, the agglomerated powder is compacted at a pressure between about 400 and 800 MPa and subsequently sintered at e.g. 1250° C. for 45 minutes in 95/5 $N_2/H_2$. Sizing is performed at eg 800 MPa, carburizing at 860° C. for eg 30 minutes in about 0.9% C and tempering is carried out at a temperature of about 180° C. for about 60 minutes.

The properties of a compacted and sintered product obtained from an agglomerated powder according to the invention were superior to the properties of a corresponding material which was obtained with a non-agglomerated powder.

The invention is illustrated by the following non-limiting examples.

| Group | Material |
|---|---|
| 1 | Astaloy Mo* < 75 $\mu$m + MnS (5%, 15%) + MnS (20 $\mu$m, <60 $\mu$m) |
| 2 | Cold PMo* + MnS (5%, 15%) |
| 3 | M3/2** + MnS (5%, 15%) + 7,74% NbC/5% TiC |

*Available from Höganäs AB, Sweden
**Standard quality of high-speed steel available from Coldstream A.S., Belgium.

Granulation

A powder mix of 20 kg is prepared and put in a Y-cone mixer. The acetone and the binder (cellulose acetate butyrate) are added to the mix according to the schedule stated below.

0.15% binder (group 1 and 2 materials)
0.3% binder (group 3 materials)
4.0% acetone (group 1 and 2 materials)
6.0% acetone (group 3 materials)

Process schedule:

1. Mixing of dry powder
2. Evacuation of mixer
3. Fill mixer with $N_2$
4. Start the intensifier, add the solvent with the intensifier running. Continuously adjust the pressure so that slight under-pressure is kept
5. Let the intensifier run until the mixture is homogeneous.
6. Dry/evacuate the powder until the pressure is about 2–10 mbar 7. Run the mixer 2–10 more minutes
8. Fill the mixer with $N_2$ to atmospheric pressure
9. Empty the mixer The group 3 materials needed extra binder and solvent for the granulation to be sufficient.

Materials

Group 1

Two parameters and two levels are tested with one additional mid-point. The first parameter is the amount of Mns, added, the low level is 5% MnS and the high is 15% MnS. The second parameter is the type of MnS. The first type of MnS is the normal MnS which is added to PM mixes as machining aid and the second type of MnS is a course MnS with a particle size essentially between 60 μm and 120 μm using a tyler mesh standard sieve. The mid-point is 10% MnS, that is a mix of 50% normal MnS that has an average particle size essentially less than 60 μm and 50% of material that has a particle size essentially between 60 μm and 120 μm. As no hard phase is added, the amount of binder can be kept low and the compressibility is not much reduced.

| Material | Composition |
|---|---|
| ST-1 | 95% Base material + 5% MnS less than 60 μm + 0.4% H-wax |
| ST-2 | 95% Base material + 5% MnS 60–120 μm + 0.4% H-wax |
| ST-3 | 85% Base material + 15% MnS less than 60 μm + 0.4% H-wax |
| ST-4 | 85% Base material + 15% MnS 60–120 μm + 0.4% H-wax |
| ST-5 | 90% Base material + 10% MnS mix |

Base material 97.6% Astaloy Mo <75+0.4% graphite
MnS mix 50% MnS having an average particle size essentially less than 60 μm and 50% MnS having a particle size essentially between 60 and 120 μm
Granulation aid 0.15% binder

| Material | AD g/cm³ | Flow sec/50 g | GD g/cm³ | P | Mn | Mo | Cu |
|---|---|---|---|---|---|---|---|
| ST-1 | 3,39 | 25,77 | 6,66 | 0,21 | 3,0 | 1,4 | 1,6 |
| ST-2 | 3,42 | 26,97 | 6,64 | 0,20 | 3,2 | 1,3 | 1,6 |
| ST-3 | 3,02 | 31,98 | 6,13 | 0,17 | 8,8 | 1,1 | 1,4 |
| ST-4 | 3,08 | 29,88 | 6,08 | 0,18 | 8,8 | 1,1 | 1,4 |
| ST-5 | 3,10 | 29,90 | 6,40 | 0,20 | 5,7 | 1,1 | 1,4 |

Group 2

A sintered component based on Cold PMo contains a lot of carbides after sintering. Addition of hard phase requires an increased sintering temperature and is not good for the mechanical properties of the material.

As in the previous group when no hard phase is added the amount of binder can be kept low and the compressibility is not much reduced.

| Material | Composition |
|---|---|
| A-1 | 100% Cold PMo |
| A-2 | 95% Cold PMo + 5% MnS mix + 0,4% H-wax |
| A-3 | 90% Cold PMo + 10% MnS mix + 0,4% H-wax |
| A-4 | 85% Cold PMo + 15% MnS mix + 0,4% H-wax |
| A-5 | 85% Cold PMo + 15% MnS mix |
| A-6 | 90% Astaloy Mo < 75 μm + 10% MnS mix |

Cold PMo=95% prealloyed, water atomized with 10% molybdenum, to which are added 1.15% graphite and 3.585 $Fe_3P$ MnS mix=50% MnS having a particle size essentially less than 60 μm and 50% MnS having a particle size essentially between 60 and 120 μm
Granulation aid 0.15% binder

| Material | AD g/cm³ | flow sec/50 g | GD g/cm³ | P | Mn | Mo | Cu |
|---|---|---|---|---|---|---|---|
| A-1 | 3,32 | 24,06 | 6,45 | 0,46 | 2,8 | 10 | |
| A-2 | 3,49 | 23,33 | 6,32 | 0,42 | 3,0 | 9,6 | |
| A-3 | 3,29 | 25,17 | 6,10 | 0,40 | 5,8 | 9,1 | |
| A-4 | 3,17 | 26,18 | 5,91 | 0,43 | 9,4 | 8,3 | |
| A-5 | 3,11 | 25,46 | 5,88 | 0,45 | 9,4 | 6,3 | |
| A-6 | 3,20 | 29,95 | 6,44 | — | 5,8 | 1,2 | 1,6 |

Group 3

The third group of materials is high-speed steel mixes. The carbides are useful in order to improve the wear resistance. The hard phase together with the M3/2 that has poor compressibility gives the materials with the lowest compressibility.

| Material | Composition |
|---|---|
| BF-1 | 86,76% M3/2 + 5% MnS* + 7,74% NbC + 0,5% H-wax |
| BF-2 | 76,76% M3/2 + 15% MnS* + 7,74% NbC + 0,5% H-wax |
| BF-3 | 89,5% M3/2 + 5% MnS* + 5% TiC + 0,5% H-wax |
| BF-4 | 79,5% M3/2 + 15% MnS* + 5% TiC + 0,5% H-wax |

| Material | AD g/cm³ | flow sec/5 0 g | GD g/cm³ | P | Mn | Mo | Cu |
|---|---|---|---|---|---|---|---|
| BF-1 | 2,62 | 36,23 | 6,07 | | | | |
| BF-2 | 2,74 | 36,62 | 5,85 | | | | |
| BF-3 | 2,62 | 36,23 | 5,88 | | | | |
| BF-4 | 2,72 | 37,00 | 5,71 | | | | |

The above tables disclose that a flow between 25 and 40 sek/50 g can be obtained using the agglomeration process according to the present invention. No flow could be obtained for the untreated non-agglomerated powders.

What is claimed is:

1. A process for the preparation of a free flowing agglomerated iron-based powder comprising mixing dry ingredients of:

a) 63–95% by weight of an iron base powder consisting essentially of iron and having a particle size essentially less than 75 μm;

b) 5–20% by weight of a lubricating phase having a particle size essentially less than 120 μm;

c) 0–15% by weight of a hard phase material having a particle size essentially less than 10 μm; and d) 0–7% of additives in a mixing chamber;

filling the mixing chamber with an inert gas;

mixing the ingredients with at most 1 % by weight, based on the total mixture, of a binding agent and adding a solvent; and drying the obtained powder.

2. The process according to claim 1, wherein the lubricating phase essentially consists of MnS and/or the lubricating phase has a particle size essentially less than 60 μm.

3. The process according to claim 1, wherein the hard phase is selected from the group consisting of carbides optionally including NbC, TiC, VC and TaC.

4. The process according to claim 1, wherein the additive is selected from the group consisting of $Fe_3P$, graphite and/or various conventional lubricants optionally including waxes, stearates and polymers.

5. The process according to claim 2, wherein the hard phase is selected from the group consisting of carbides optionally including NbC, TiC, VC and TaC.

6. The process according to claim 2, wherein the additive is selected from the group consisting of $Fe_3P$, graphite and/or various conventional lubricants optionally including waxes, stearates and polymers.

7. The process according to claim 3, wherein the additive is selected from the group consisting of $Fe_3P$, graphite and/or various conventional lubricants optionally including waxes, stearates and polymers.

8. The process according to claim 5, wherein the additive is selected form the group consisting of $Fe_3P$, graphite and/or various conventional lubricants optionally including waxes, stearates and polymers.

* * * * *